United States Patent [19]

George, Jr.

[11] Patent Number: 4,664,265

[45] Date of Patent: May 12, 1987

[54] CIRCUIT BOARD CARRIER

[75] Inventor: Abner H. George, Jr., South St. Paul, Minn.

[73] Assignee: Liberty Diversified Industries, Minneapolis, Minn.

[21] Appl. No.: 872,154

[22] Filed: Jun. 9, 1986

[51] Int. Cl.[4] ..... B25H 3/04

[52] U.S. Cl. ..... 211/41; 211/189; 361/415

[58] Field of Search ..... 211/41, 40, 189; 361/415, 397, 399

[56] References Cited

U.S. PATENT DOCUMENTS 4,158,220 6/1979 Yamamoto et al. ..... 361/415

4,184,599 1/1980 Drake et al. ..... 211/41

4,385,781 5/1983 Welsch et al. ..... 211/41 X 4,434,899 3/1984 Rivkin ..... 211/41

4,600,231 7/1986 Sickles ..... 211/41 X

*Primary Examiner*—Robert W. Gibson, Jr.

*Attorney, Agent, or Firm*—Williamson, Bains, Moore & Hansen

[57] ABSTRACT

A carrier for circuit boards and the like provides an adjustable, rigid, precision aligned structure having only three types of elements held together by a few screw fasteners. Rigidly straight glide plates have rows of partially punched out glide lugs which provide low friction, nonjamming insertion and removal of boards by automatic equipment.

43 Claims, 12 Drawing Figures

CIRCUIT BOARD CARRIER

BACKGROUND OF THE INVENTION

1. Field of the Invention

This invention relates to carriers for fragile flat articles and the like. More particularly, this invention relates to printed circuit board carriers which are useful at assembly work stations as well as for protective storage and transportation.

2. Information Disclosure Statement

Numerous carriers and holders for printed circuit boards have been devised. An example of such a carrier is shown in Rivkin U.S. Pat. No. 4,434,899 which provides for parallel slotted board holders mounted on a wire framework. The slots or grooves in the board holders are formed by pressing a series of straight ribs from the back side of the board holders. The resulting metal drawing tends to produce board holders which are slightly bowed in the vertical direction. Circuit boards or cards inserted in slots in the middle portion of the board holder fit more tightly than those near the ends. When such carriers are used at a robotic work station, the extraction force may exceed the tolerance range of the robot, and the circuit board may be bypassed.

Similar board holders are made of injection molded plastic, requiring metal end walls to maintain sufficiently precise alignment.

Prior circuit board carriers are often complex, requiring assembly of many different parts. Other disadvantages are excessive room taken up for storage, an inability to dissemble, nonstackability, and difficulty in precise alignment.

SUMMARY OF THE INVENTION

Therefore, it is an object of this invention to provide an improved circuit board carrier for processing and storage of printed circuit boards.

Another object is to provide an improved, compact carrier for a plurality of circuit boards wherein the novel structure is simple and economical to assemble.

A further object is to provide an improved carrier which comprises a small number of interchangeable elements to reduce parts inventory.

An object of this invention is to provide a circuit board carrier which is easily dissembled into parts which occupy little storage space.

A further object is to provide an improved circuit board carrier in which the "shelves" on the board holders or glide plates may be easily and precisely adjusted in a rigid structure for precise manipulation of the circuit boards by manual or automatic robotic means.

A still further object is to provide glide plate structure which is not easily warped during construction or use.

An additional object is to provide a carrier in which circuit boards do not stick or jam but glide with minimal effort when inserted or extracted.

A further object is to provide a carrier in which circuit boards are accessible from either the front or rear.

The foregoing objects as well as additional objects and advantages are achieved in the present invention This novel circuit board is comprised of several elements, including a base and a cover which is superposed above the base and parallel to it. Two lateral glide plates are arrayed in opposed space alignment between the base and cover. Each glide plate is preferably comprised of one or more coplanar glide panels with spaced parallel rows of inwardly facing, inwardly extending, partially punched out glide lugs for glideable support of a plurality of circuit boards and the like. Each row of glide lugs forms a shelf for supporting one edge of a circuit board. Corresponding rows of lugs in the two glide plates cooperate to support opposite edges of circuit boards. Each glide plate is fixedly attached to a plurality of vertically disposed glide plate supports. Each glide plate support is attached at its lower end to the base and at its upper end to the cover.

This invention uses three types of structural members to create a circuit board carrier with numerous advantages over the prior art. The base and cover are corresponding members, and may be in fact completely interchangeable. The two glide plates are similar, and may be identical in construction. The glide plate supports are preferably constructed to be completely interchangeable. The glide plates are attached to the supports, and the supports are attached to the base and cover to provide the desired spacing between the glide plates for holding circuit boards, cards, or other materials of similar shape.

DESCRIPTION OF THE PREFERRED EMBODIMENTS

Figure 1:
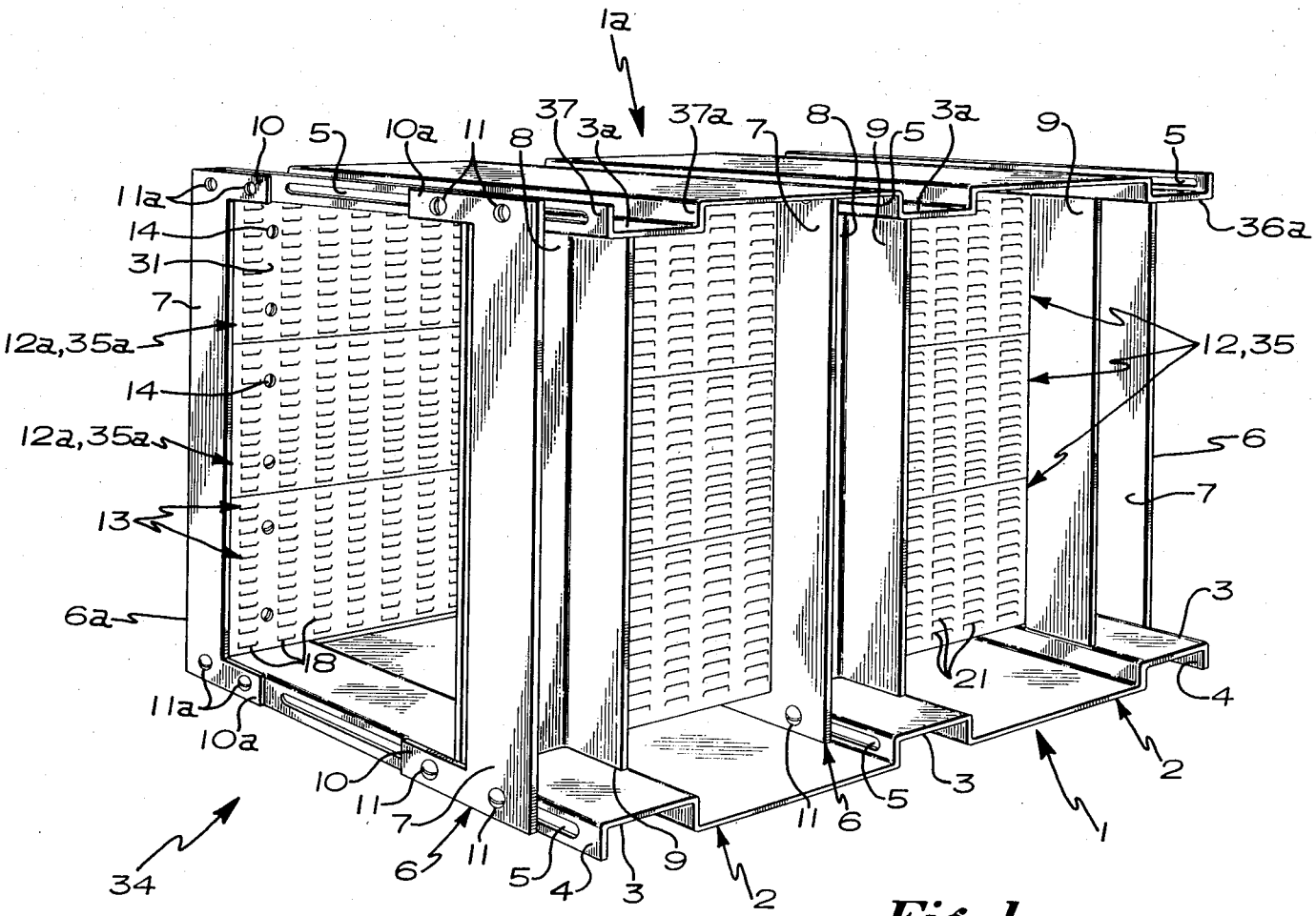
FIG. 1 is a perspective view of an embodiment of the circuit board carrier of this invention.

As illustrated in FIG. 1, the circuit board carrier 34 of this invention comprises base 1, cover 1A, and laterally opposed glide panels 12 and 12A. Each set of one or more coplanar glide panels 12 and 12A comprises a glide plate 35 or 35A. The two sets of glide panels are laterally aligned between base 1 and cover 1A. The set of coplanar glide panels comprising each glide plate is fixedly attached to a plurality of glide plate supports 6 or 6A. Each glide plate support 6 and 6A is attached at its lower end to the base 1 and at its upper end to cover 1A. Each glide plate is thus rigidly supported by two or more supports 6 or 6A. Each glide panel has a generally flat, inwardly facing surface 31 which has spaced parallel rows of shelves 13 for edge support of a plurality of circuit boards or similar materials.

The individual elements of the various embodiments will now be described by referring to the detailed drawing or drawings showing the element, and to FIG. 1 showing an assembled embodiment of the carrier.

Figure 2:
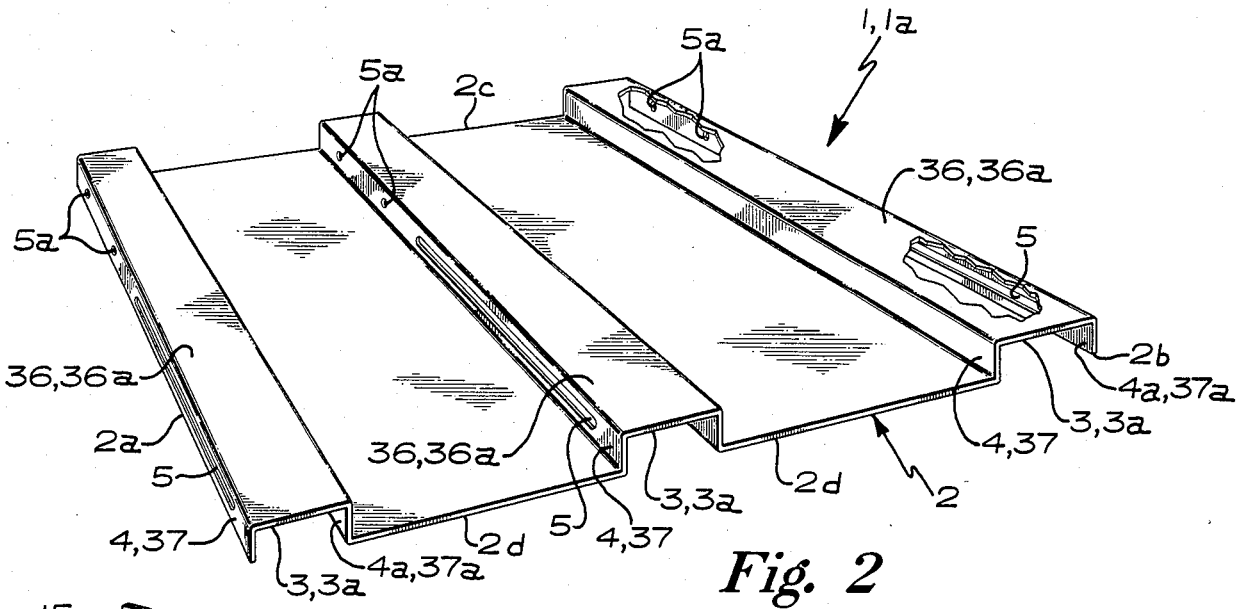
FIG. 2 is a perspective view of the base plate of FIG. 1, which in identical but inverted form is interchangeable with the top plate.

Turning now to FIG. 2 in combination with FIG. 1, we see a preferred embodiment of base 1 having a floor 2 and two or more transverse raised rails 3 elevated above floor 2. The number of rails on the base is preferably 2–4, and most preferably 3.

In its most preferred configuration, base 1 is integrally formed from a single sheet or plate with front edge 2A, back edge 2B, first side edge 2C, and second side edge 2D. Each rail 3 comprises a portion of base 1 which forms an elevated platform 36 extending from first side edge 2C to the second side edge 2D. Each platform 36 is joined to front and rear vertically disposed parallel raised rail walls 4 and 4A, respectively. One or both of the raised rail walls join platform 36 to floor 2. Rails located at the front and rearmost portion of the base 1 are preferably joined to floor 2 by one raised rail wall 4 or 4A only. Additionally, one or both raised rail walls 4 and 4A have apertures 5 and 5A therein for attaching glide plate supports 6, 6A to rails 3. FIG. 2 shows apertures 5 as slots and apertures 5A as spaced holes. Either slots, holes, or a combination of slots and holes may be used in the most preferred embodiment; other means for attaching glide plate supports 6, 6A to the rails may also be used.

Base 1 may be molded plastic or other material but preferably is constructed of a single metal sheet or plate. Thus, the spaced rails 3 may be formed by appropriate transverse bending of the sheet or plate.

Cover 1A has the same general construction as base 1. Thus, FIG. 2 applies equally well to the cover, except the cover is inverted so that rails 3A, being inverted, each comprise a portion of the cover forming a suspended platform 36A joined to front and rear vertically disposed parallel inverted rail walls 37 and 37A. Thus, each inverted rail 3A is a mirror image of a corresponding raised rail 3, and the inverted rail walls 37 and 37A correspond to raised rail walls 4 and 4A of the base, and the base 1 and cover 1A are interchangeable.

The drawing of FIG. 1 shows a carrier 34 having three glide plate supports 6 joining one side of the base 1 and cover 1A. The other side of base 1 and cover 1A is also joined by three glide plate supports 6A. Each set of three glide plate supports is fixedly attached to one or more (in this example, three) glide panels 12 or 12A which make up glide plates 35 and 35A, respectively. Thus, each support 6 is attached to glide plate 35 and each support 6A is attached to glide plate 35A. Each set of one or more coplanar panels comprises a glide plate, which together with the attached glide plate supports form a glide assembly.

Figure 3:
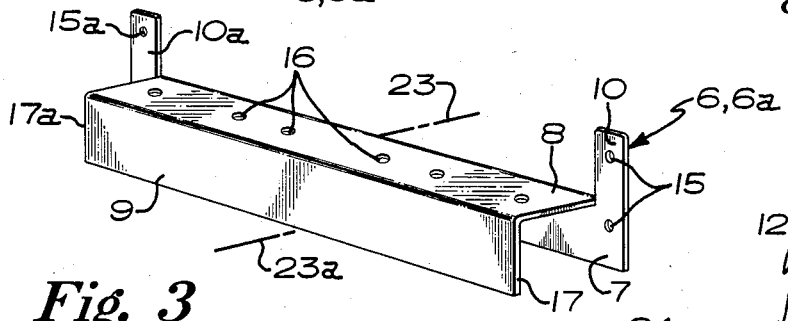
FIG. 3 is a perspective view of a glide plate support of the embodiment of FIG. 1, and is placed horizontally to show construction details.
Figure 10:
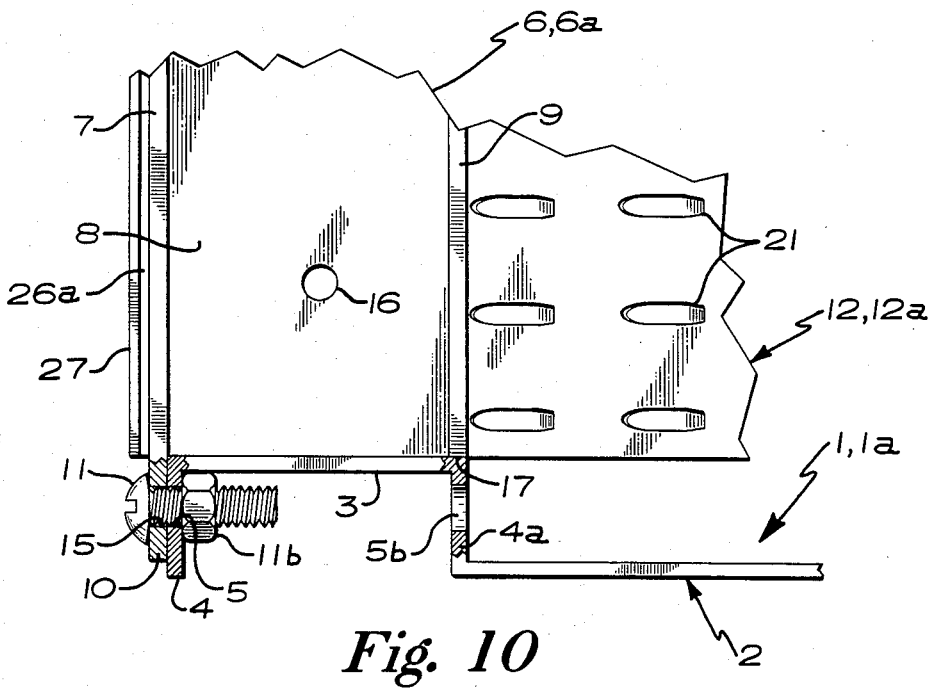
FIGS. 10 and 11 are side views of a corner of the circuit board carrier showing alternative placements of the glide plate supports.
Figure 11:
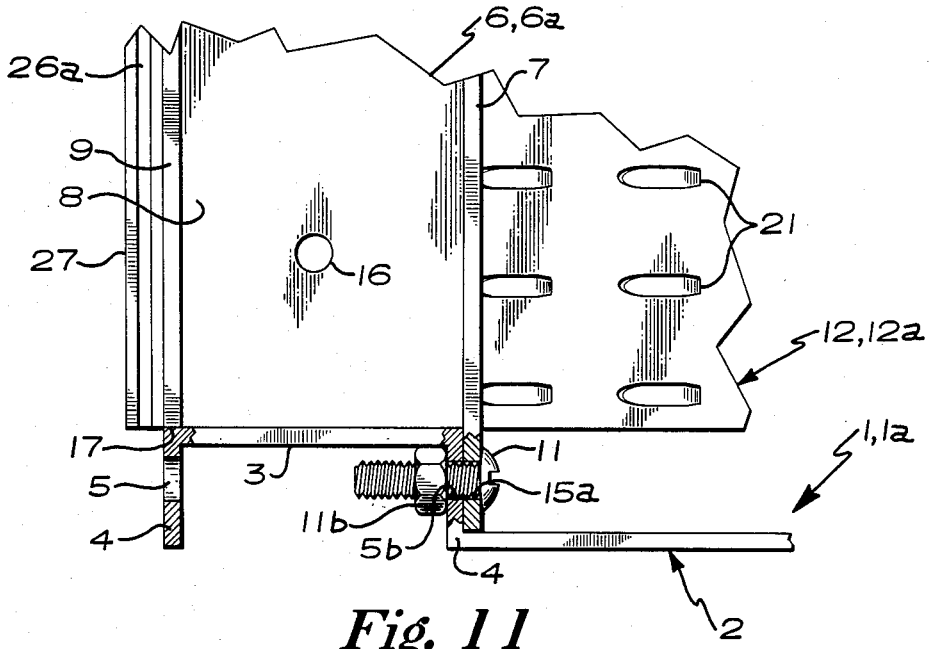

A preferred glide plate support 6 or 6A is depicted in FIG. 3. The support is a channel-shaped member integrally formed from a single sheet or plate with a first wall 7, a second wall 8, and a third wall 9. The first support wall 7 includes an extended tab 10, 10A at each end. One tab is attached to and communicates with a raised rail 3 and the other tab to a corresponding inverted rail 3A, by passing screw fasteners 11 or 11A through holes 15 or 15A and corresponding holes 5A or slots 5, as illustrated in FIGS. 1 and 2. The second support wall 8 is attached to a glide plate 35 or 35A by screwed fasteners 14 passed through holes 16 in the glide plate support and corresponding holes 24 in the glide plate. The opposite ends 17 and 17A of the second and third walls 8 and 9 abut the elevated platform 36 of a raised rail 3 and the suspended platform 36A of an inverted rail 3A. FIGS. 10 and 11 show alternative ways of attaching a glide plate support 6 and 6A to a raised rail 3 at one end of base 1. In FIG. 10, first support wall 7 with holes 15 in tab 10 is attached to front raised rail wall 4 with slot 5 by screw fasteners 11 and 11B. Hole 5B in rear raised rail wall 4A is not used. The bottom end 17 of second wall 8 and third wall 9 abuts the upper surface of elevated platform 36. Likewise, the opposite end of glide plate support 6 or 6A is attached in a corresponding manner to cover 1A, not shown, wherein first support wall 7 with holes 15A in tab 10A is attached to front inverted rail wall 37 with slot 5 by screw fasteners 11 and 11B. The upper end 17A of second wall 8 and third wall 9 abuts the lower surface of suspended platform 36A. Glide plate 12 or 12A is attached to glide plate support 6 or 6A with a plurality of screw fasteners 14 passing through holes 16 and 24. The complete assembly is illustrated in FIG. 1.

The two halves of the glide plate support, separated by the plane passing through lines 23 and 23A in FIG. 3, are mirror images of one another. Therefore, either end may be the upper or lower end. When the ends are rotated to the opposite configuration, the tabs 10 and 10A are also changed with respect to their attachment point. If, as in FIG. 10, both tabs are attached to front rail walls 4, 37, reversing the ends of support 6 or 6A enables attachment of the tabs to the rear rail walls 4A, 37A instead of the front walls 4, 37 as illustrated in FIG. 11. Thus, each glide plate support is not only interchangeable with every other support, but may be used in two different positions at each support location in the circuit board carrier.

Figure 9:
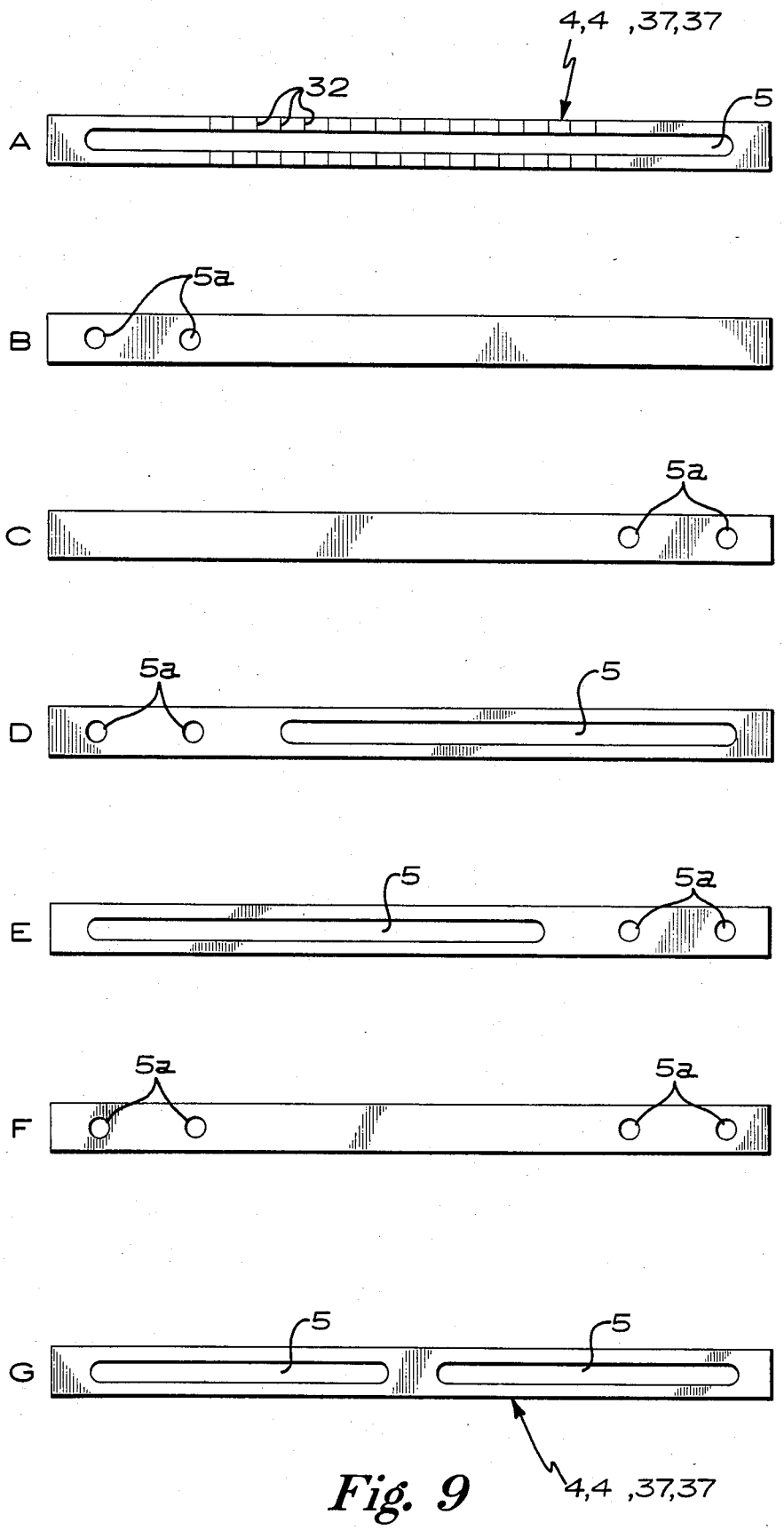
FIG. 9 is a front view of rails depicting various combinations of slots and screw holes for attaching glide plate supports to the base plate and top plate.

FIG. 9 illustrates several configurations of apertures comprising slots 5 and holes 5A in either or both of the front rail walls 4, 37 and rear rail walls 4A, 37A. Where the carrier 34 is to be used for circuit boards which do not vary in width, all apertures may comprise holes 5A. For example, a front rail may use configuration B and a rear rail configuration C, or vice versa. Preferably, configuration F may be used for one or both rail walls of each rail in this situation.

In other situations, where circuit board width may vary, the spacing between glide plates 35 and 35A may be easily adjusted by using slots 5 or additional spaced holes along the rail wall. In the latter configuration, adjustment is limited to the particular hole locations, and the screw fasteners 11, 11A must be completely removed from each hole 5A when adjustment is made. On the other hand, the use of slots 5 provides for continuous adjustment between the slot ends. Configurations A, D, E, or G may be used incorporated in a single rail wall, or with both rail walls of a rail. Where it may sometimes be desirable to have one glide plate at a fixed indexed location, configuration B, C, D, E, or F may be used on one rail wall and configuration A or G on the other rail wall of each rail, to provide for complete continuous adjustment of both glide plates for accommodating different circuit board widths. Configurations D and E, by themselves, permit adjustment of one glide plate to accommodate different circuit board widths.

Indicia markings on rails 4, 4A, 37, 37A may optionally be used. Such markings relate the particular glide plate support location on the rail to the resulting spacing between the first and second glide plates, and enable quick adjustment to accommodate various circuit board sizes.

Figure 4:
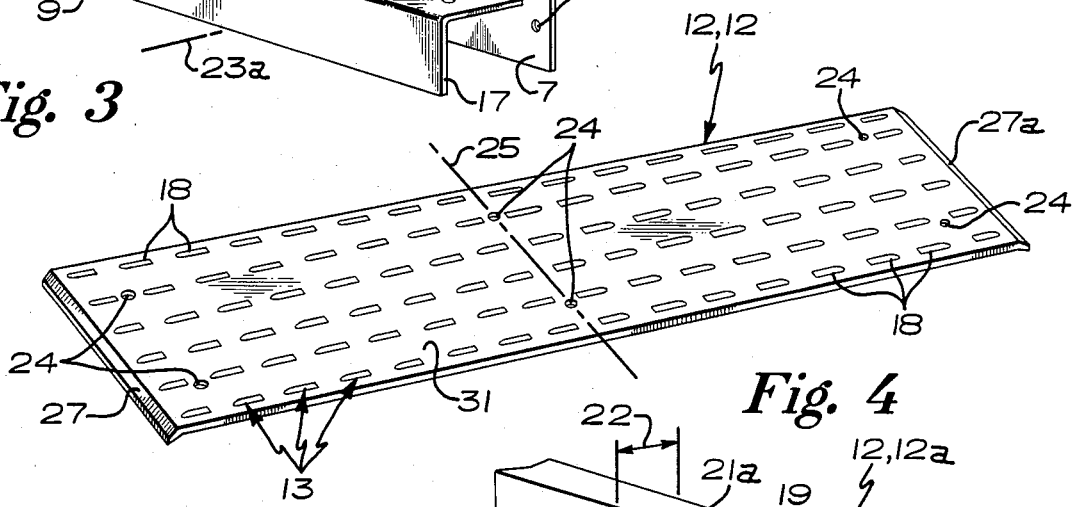
FIG. 4 is a perspective view of a glide plate of this invention.
Figure 5:
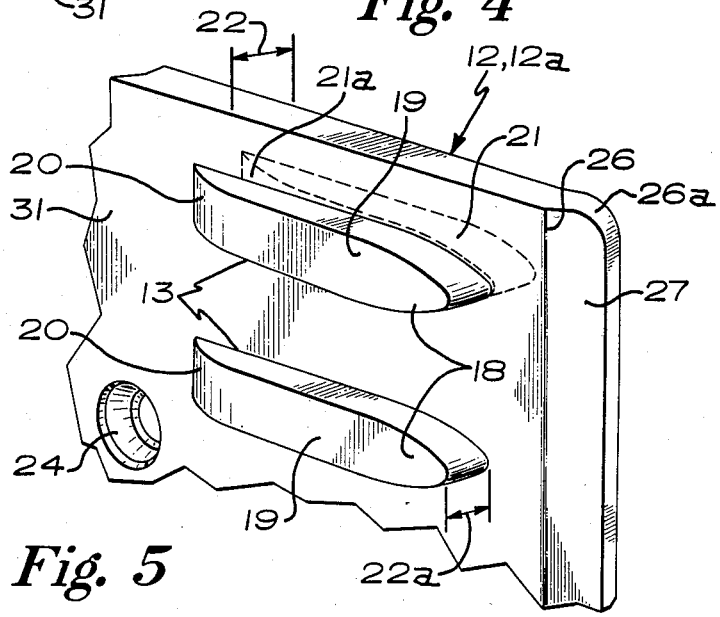
FIG. 5 is an enlarged perspective view of a corner portion of the glide plate of FIG. 4, indicating construction details of the glide lugs.
Figure 6:
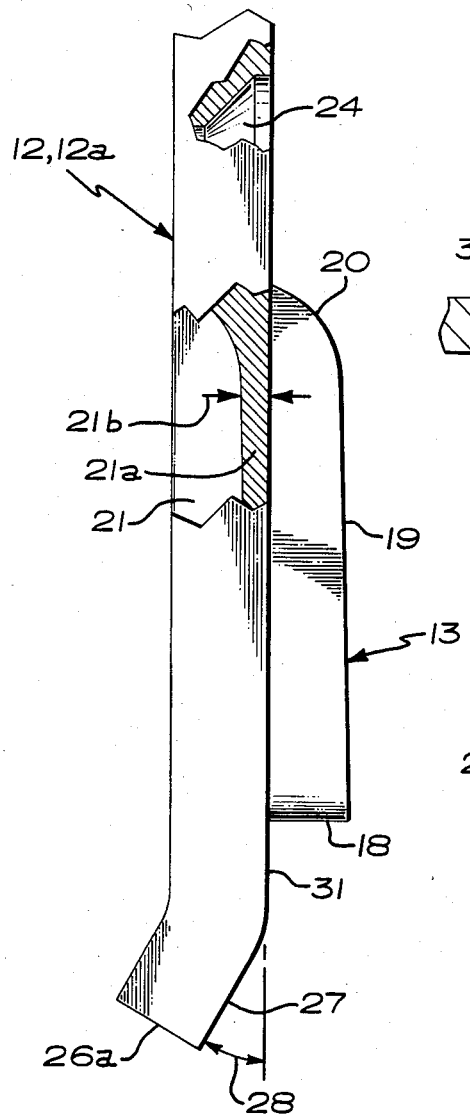
FIG. 6 is a top view of a portion of the glide plate of FIG. 4.

As can be seen in FIG. 4, the preferred glide panels 12, 12A which make up glide plates 35, 35A have a generally flat, inwardly facing surface 31 with spaced parallel rows of support means 13 for edge support of a plurality of circuit boards. A completely assembly circuit board carrier is shown in FIG. 1, where first glide plate 35 and second glide plate 35A are laterally opposed in spaced alignment between base 1 and cover 1A. In this example, each glide plate is made up of three coplanar glide panels 12 and 12A, respectively. Each panel is fixedly attached to three glide plate supports 6, 6A by screw fasteners 14 passing through holes 24 in the glide panel and holes 16 in the glide plate supports. The support means 13 comprises glide lugs in spaced parallel rows, each row supporting one edge of a circuit board or the like. Glide lugs 13 on each glide plate face inwardly and extend inwardly, that is, toward the opposite glide plate. As shown in FIGS. 5 and 6, glide lugs 13 are in preferred form, partially punched out, i.e., struck, or expanded out from the glide panel 12 or 12A. The inward extension 22A at the leading end 18 of each lug 13 is preferably greater than the extension at the trailing end 20. The maximum extension is typically about 0.1 inch (2.54 mm).

The lugs are partially punched out so that a continuous web 21A of glide panel material bonds lug 13 to glide panel 12, 12A over the entire interfacial perimeter of the lug. As a result, the lug does not break loose from the glide panel at any point. The punching operation leaves punch out cavities 21 in the glide panel wall. Furthermore, the formation of burrs at the interface of lugs 13 and surface 31, or on the lug itself is avoided. Such burrs, if not moved by etching or some other process, scratch and mar circuit boards. Preferably, the web thickness increases from the leading edge of the lug to the trailing edge. The web 21A has a thickness 21B whose mean is 15–50 percent of the thickness 22 of the glide panel.

Figure 12:
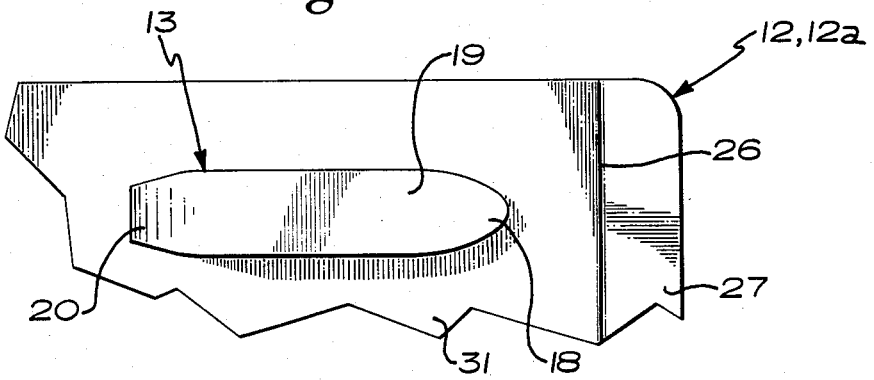
FIG. 12 is a side elevation of a corner portion of a glide plate, showing an additional embodiment of glide lug.

In a preferred form, glide lugs 13 are generally bullet shaped extrusions having a rounded leading end 18 as viewed perpendicularly from the glide panel 12 or 12A. In a further embodiment shown in the side elevation of FIG. 12, the lugs 13 also have narrowed tapering trailing end 20. Preferably, the taper is slight, and may reduce the vertical face dimension of the lug by only 0.5 mm from its maximum face dimension in the middle portion 19. The middle portion 19 of the lug is generally flat on its upper and lower support surfaces for slideably supporting circuit boards in precise alignment.

In one embodiment, the endmost glide lugs 13 in each row of glide lugs have a rounded leading end 18 directed toward the nearest end of the row. Thus, circuit boards are easily inserted onto the rounded leading ends 18. In a further embodiment, each glide lug 13 in the glide panel 12, 12A has a rounded leading end 18 directed toward the nearest end of the glide plate 35, 35A. As shown in FIG. 4, the ends of each glide plate 35, 35A or glide panel 12, 12A are mirror images of each other, all lugs pointing toward the nearest end of the panel or plate.

In a still further embodiment, glide lugs 13 have rounded leading ends 18 directed toward the panel end where circuit boards are to be inserted.

Preferably, all glide lugs 13 in a glide panel 12, 12A are punched out in a single operation; for example, by a hardened gratelike tool.

The glide lugs are preferably metal, most preferably aluminum, stainless steel, titanium, a copper alloy, or a precious metal.

In each row of lugs, in one embodiment, the total aggregate length of lugs comprises less than 70 percent, and more preferably less than 60 percent, of the total length of the panel 12 or 12A.

An additional feature of this invention is shown in FIGS. 4, 5, and 6. The front and/or rear edge 26A of glide panel 12 or 12A is bent outwardly, that is, away from glide panel surface 31, along bend line 26, at an angle 28. The bent edge 26A forms a ramp 27 at the front edge and/or ramp 27A at the rear edge for easy insertion of circuit boards from the front and/or rear. The preferred ramp angle 28 is 8–35 degrees.

Figure 7:
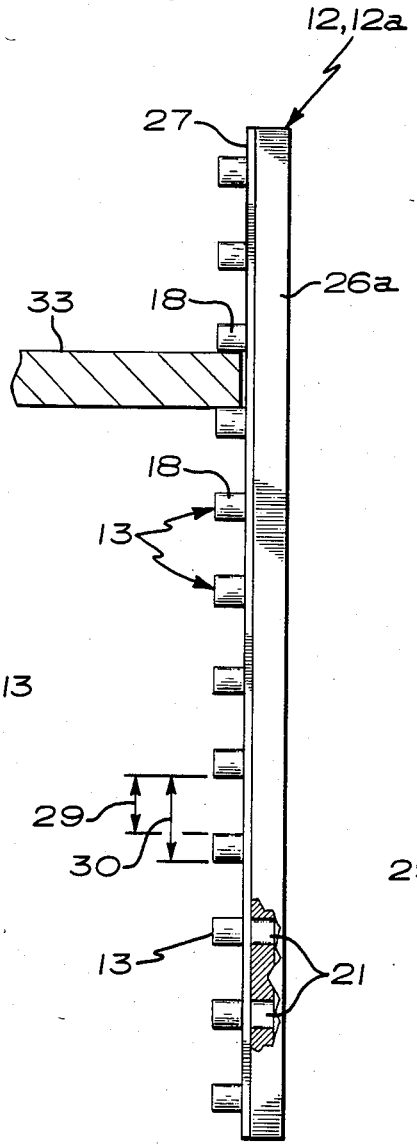
FIGS. 7 and 8 are end views of a glide plate showing two variations in the spacing of glider lugs.
Figure 8:
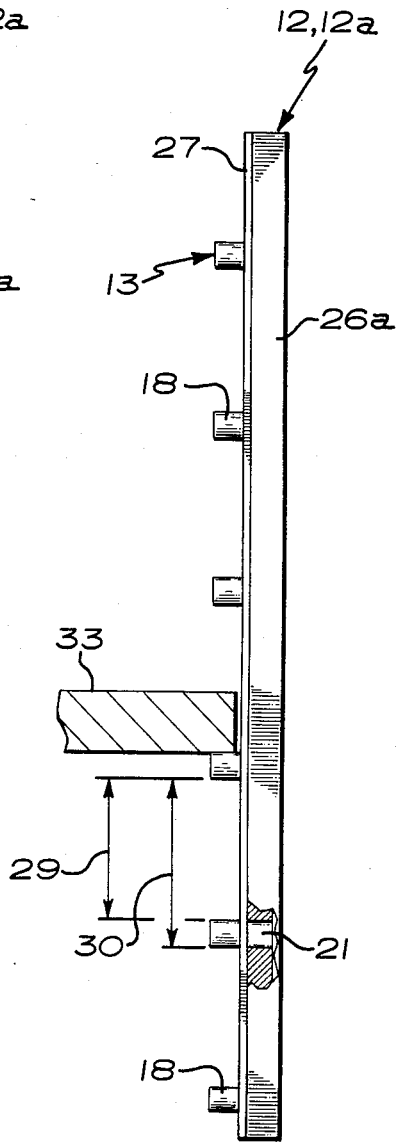

FIGS. 7 and 8 are end views of different glide panels 12, 12A, showing the rows of lugs 13 which support circuit boards 33. The ramp 27 is shown, as are punch-out cavities 21. As shown in these drawings, the lug spacing 30 and the interlug spacing 29 may vary depending on the particular application. The interlug spacing 29 corresponds to the maximum circuit board width which can be accommodated.

In its preferred embodiment as described, the base 1 and cover 14 are interchangeable, the glide panels 12, 12A are interchangeable, and the glide plate supports 6, 6A are interchangable. Inventory of parts is thus limited to three elements in addition to the screw fasteners.

The apparatus is easily and quickly assembled or taken apart, being held together by a small number of screw fasteners.

Furthermore, the base, cover, and glide plate supports are easily fabricated from metal plate or sheet material using simple cutting, bending and drilling operations.

A prime use for this invention is to hold circuit boards which are undergoing manufacturing operations by automated robotic manipulation. Such operations require precise alignment of the boards in a carrier from which the boards can be removed with minimum force and without jamming. The manufacture of the glide panels of this invention avoids the warping found in panels formed by other methods. Typically, the inner surface of such panels is warped convexly. Circuit boards inserted in the central portion of the panels fit more tightly, and the force tolerance range of the robotic manipulator is exceeded, causing rejection of the boards. Precision spacing of the rigid glide plates from each other and alignment with other apparatuses is easily accomplished. The base and cover provide precise edges which may be used for aligning the carrier with respect to board manipulating machines with narrow alignment tolerances.

The carrier is also readily adjustable to handle circuit boards of different widths, without additional apparatus.

The shelves formed by the rows of lugs have particular advantages. The widest portion of the shelf surface formed by a lug is at the leading end, where it is advantageous for supportively contacting the circuit board. The widest portion of the lug retaining web is at the trailing end to provide the strength required to prevent lugs from being broken off during use. The lugs are only incompletely or partially punched out, so that the continuous web provides a strong solid bond between lug and glide panel at all points of the interface. Furthermore, the formation of board damaging burrs is avoided.

The rounded leading edge of each lug prevents sharp edges from damaging the circuit boards or other fragile items inserted into the carrier. Such damage is also avoided by the ramp on the glide plates where such materials are inserted.

The foregoing description depicts the invention as having a particular spatial orientation wherein the base and cover are horizontal members with the cover superposed above the base. The glide plates are described as aligned vertically and attached to vertically oriented glide plate supports. The orientation terms are used to conveniently describe the relationships between the various elements, but are not meant to limit the spatial orientation of the invention. The carrier may be used in any orientation which a particular application may require. For example, the carrier may be alternatively positioned so that the inserted boards are in a horizontal or vertical plane. Furthermore, boards may be inserted into the carrier horizontally, upwardly, or downwardly, depending upon the requirements of the application.

Although the invention described above has been delineated with reference to specific preferred embodiments, it is evident to those skilled in the art thereof that changes and modifications may be made thereto which will lie within the scope of the invention as defined in the following claims.

What is claimed is:

1. A circuit board carrier, comprising:

a base;

a cover superposed above said base in parallel spaced relationship thereto;

first and second glide plates in laterally opposed spaced alignment between said base and cover, each said glide plate comprising one or more coplanar glide panels having spaced parallel rows of inwardly facing, inwardly extending, partially punched out glide lugs for glideable support of a plurality of circuit boards;

a plurality of vertically disposed glide plate supports fixedly attached to said first glide plate, and attached at its lower and upper end to said base and cover, respectively; and a plurality of vertically disposed glide plate supports fixedly attached to said second glide plate, and attached at its lower and upper end to said base and cover, respectively.

2. The circuit board carrier according to claim 1, wherein:

said glide lugs are partially punched out to provide a continuous web bonding said glide panel to the entire interfacial perimeter of each said glide lug.

3. The circuit board carrier according to claim 2, wherein:

said web has a mean thickness which is 15–50 percent of the thickness of said glide panel.

4. The circuit board carrier according to claim 1 wherein:

said inward extension of said lugs from said panels is greater at the leading end than at the trailing end of said lugs.

5. The circuit board carrier according to claim 1 wherein:

the total aggregate length of said lugs in each row on said guide panel comprises less than 70 percent of the total length of said panel.

6. The circuit board carrier according to claim 1 wherein:

the total aggregate length of said lugs in each row on said glide panel comprises less than 60 percent of the total length of said panel.

7. The circuit board carrier according to claim 1, wherein:

said glide lugs comprise generally bullet-shaped extrusions having a rounded leading end as viewed perpendicularly from said glide panel.

8. The circuit board carrier according to claim 1, wherein:

said glide lugs comprise generally bullet-shaped extrusions having a rounded leading end and a narrowed tapering trailing end, as viewed perpendicularly from said glide panel.

9. The circuit board carrier according to claim 1, wherein:

the endmost glide lugs in each said row of glide lugs have a rounded leading end directed toward the nearest end of said row.

10. The circuit board carrier according to claim 1, wherein:

each said glide lug in each said glide plate has a rounded leading end directed toward the nearest end of said glide plate.

11. The circuit board carrier according to claim 1, wherein:

said glide lugs in said glide plates have rounded leading ends directed toward the end wherein circuit boards are to be inserted.

12. The circuit board carrier according to claim 1, wherein:

the front and/or rear edge of each said glide panel is bent outwardly at an angle to provide a ramp for inserting circuit boards from the front and/or rear edge of said glide plate.

13. The circuit board carrier according to claim 12, wherein:

said angle of said ramp is 8–35 degrees.

14. The circuit board carrier according to claim 1, wherein said glide panels are metal.

15. The circuit board carrier according to claim 1, wherein:

said glide lugs in a glide panel are punched out in a single operation.

16. The circuit board carrier according to claim 1, wherein:

said vertically disposed glide plate supports attached to at least one of said glide plates are moveably attached at said lower and upper end to said base and cover, respectively, for controllably adjusting the spacing between said first and second glide plates to accommodate different circuit board widths.

17. A circuit board carrier, comprising:

a base with a floor and two or more transverse raised rails elevated above said floor;

a cover with a deck and two or more transverse inverted rails suspended below said deck, said cover superposed above said base in parallel spaced relationship thereto;

first and second glide plates in laterally opposed spaced alignment between said base and cover, each said glide plate comprising one or more coplanar glide panels having spaced parallel rows of inwardly facing, inwardly extending, partially punched out glide lugs for glideable support of a plurality of circuit boards;

a plurality of vertically disposed glide plate supports fixedly attached to said first glide plate to form a first glide assembly extending between said raised rails of said base and said inverted rails of said cover;

a plurality of vertically disposed glide plate supports fixedly attached to said second glide plate to form a second glide assembly extending between said raised rails of said base and said inverted rails of said cover; and attachment means for attaching the lower portion of each said glide plate support to a raised rail on said base, and for attaching the upper portion of each said glide plate support to an inverted rail suspended from said cover.

18. The circuit board carrier according to claim 17, wherein:

said raised rails and inverted rails have apertures therein;

said glide plate supports have apertures at the lower and upper ends corresponding to said apertures in said raised and inverted rails, respectively; and said glide plate supports are attached to said raised rails and inverted rails by screwed fasteners passing through corresponding apertures.

19. The circuit board carrier according to claim 18, wherein:

said glide plate supports of at least one said glide assembly are moveably attached to said raised and inverted rails for controllably adjusting the spacing between said first and second glide plates to accommodate different circuit board widths.

20. The circuit board carrier according to claim 19, wherein:

apertures in said rails comprise one or more slots in each said rail for movably attaching said glide plate supports to said rails.

21. The circuit board carrier according to claim 17, wherein:

each said glide plate support comprising a channel-shaped member having a first, a second, and a third support wall integrally formed from a single sheet or plate, said first support wall including an extended tab at each end for communication with and attachment to a raised rail and a corresponding inverted rail, said second support wall attached to said glide plate, and each terminal edge of said second and third support walls abutting the adjacent rail.

22. The circuit board carrier according to claim 17, wherein:

said base is integrally formed from a single sheet or plate with a front edge, a back edge, and first and second side edges, to provide a floor and a plurality of spaced transverse rails raised above said floor and extending from said first side edge to said second side edge, each said raised rail comprising a portion of said base forming an elevated platform joined to front and rear vertically disposed parallel raised rail walls, one or both of said raised rail walls joining said elevated platform to said floor, and one or both of said rail walls having apertures therein for attaching glide plate supports to said raised rails.

23. The circuit board carrier according to claim 17, wherein:

said cover is integrally formed from a single sheet or plate with a front edge, a back edge, and first and second side edges, to provide a deck and a plurality of spaced transverse rails suspended below said deck and extending from said first side edge to said second side edge, each said suspended rails comprising a portion of said cover forming a suspended platform joined to front and rear vertically disposed parallel suspended rail walls, one or both of said suspended rail walls joining said suspended platform to said deck, and one or both of said parallel rail walls having apertures therein for attaching glide plate supports to said suspended rails.

24. The circuit board carrier according to claim 17, wherein:

said base and cover are interchangeable.

25. The circuit board carrier according to claim 17, wherein:

said base and cover are interchangeable, said first and second glide plates are interchangeable, and said glide plate supports are interchangeable.

26. The circuit board carrier according to claim 17, wherein:

said cover is a mirror image of said base.

27. The circuit board carrier according to claim 17, wherein:

said base and cover are formed from metal sheet or plate.

28. The circuit board carrier according to claim 17, further comprising indicia marks on one or more of said raised rails and/or inverted rails to indicate spacing between said first and second glide plates.

29. The circuit board carrier according to claim 17, wherein:

the number of rails in each said base and cover is two to four.

30. The circuit board carrier according to claim 17, wherein:

the number of rails in each said base and cover is three.

31. The circuit board carrier according to claim 17, wherein:

said glide lugs are partially punched out to provide a continuous web bonding said glide panel to the entire interfacial perimeter of each said glide lug.

32. The circuit board carrier according to claim 17, wherein:

said web has a mean thickness which is 15–50 percent of the thickness of said glide panel.

33. The circuit board carrier according to claim 17, wherein:

said inward extension of said lugs from said glide panels is greater at the leading end than at the trailing end of said lugs.

34. The circuit board carrier according to claim 17, wherein:

the total aggregate length of said lugs in each row on said glide panel comprises less than 70 percent of the total length of said panel.

35. The circuit board carrier according to claim 17, wherein:

the total aggregate length of said lugs in each row on said glide panel comprises less than 60 percent of the total length of said panel.

36. The circuit board carrier according to claim 17, wherein:

said glide lugs comprise generally bullet-shaped extrusions having a rounded leading end as viewed perpendicularly from said glide panel.

37. The circuit board carrier according to claim 17, wherein:

said glide lugs comprise generally bullet-shaped extrusions having a rounded leading end and a narrowed tapering trailing end, as viewed perpendicularly from said glide panel.

38. The circuit board carrier according to claim 17, wherein:

the endmost glide lugs in each said row of glide lugs have a rounded leading end directed toward the nearest end of said row.

39. The circuit board carrier according to claim 17, wherein:

each said glide lug in each said glide plate has a rounded leading end directed toward the nearest end of said glide plate.

40. The circuit board carrier according to claim 17, wherein:

said glide lugs in said glide plates have rounded leading ends directed toward the end wherein circuit boards are to be inserted.

41. The circuit board carrier according to claim 17, wherein:

the front and/or rear edge of each said glide panel is bent outwardly at an angle to provide a ramp for inserting circuit boards from the front and/or rear edge of said glide panel.

42. The circuit board carrier according to claim 41, wherein:

said angle of said ramp is 8–35 degrees.

43. The circuit board carrier according to claim 17, wherein:

said glide panels are metal.

* * * * *